US007481081B2

(12) United States Patent
Hsu et al.

(10) Patent No.: US 7,481,081 B2
(45) Date of Patent: Jan. 27, 2009

(54) AUTOMATIC STAND-ALONE DISPENSING DEVICE FOR LAUNDRY CARE COMPOSITION

(75) Inventors: Feng-Lung Gordon Hsu, Tenafly, NJ (US); Sudhakar Puvvada, Chester (GB); Gary Hsu, Tenafly, NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 749 days.

(21) Appl. No.: 10/995,709

(22) Filed: Nov. 23, 2004

(65) Prior Publication Data

US 2006/0107705 A1 May 25, 2006

(51) Int. Cl.
*D06F 39/08* (2006.01)

(52) U.S. Cl. ..... 68/17 R; 68/207

(58) Field of Classification Search ..... 68/17 R, 68/207

See application file for complete search history.

(56) References Cited

U.S. PATENT DOCUMENTS

| | | | | |
|---|---|---|---|---|
| 3,772,901 | A | 11/1973 | Ferraro | 68/18 |
| 3,881,328 | A * | 5/1975 | Kleimola et al. | 68/12.18 |
| 4,209,343 | A * | 6/1980 | Lane et al. | 134/22.12 |
| 4,932,227 | A * | 6/1990 | Hogrefe | 68/12.18 |
| 4,981,024 | A | 1/1991 | Beldham | 68/12 R |
| 5,207,080 | A * | 5/1993 | Reinhard | 68/12.18 |
| 5,392,618 | A | 2/1995 | Livingston et al. | 68/12.02 |
| 5,758,521 | A * | 6/1998 | Roberts | 68/17 R |
| 6,240,953 | B1 * | 6/2001 | Laughlin et al. | 137/268 |
| 2002/0056723 | A1 | 5/2002 | Amberg et al. | 222/92 |
| 2003/0182732 | A1 | 10/2003 | Davenet et al. | 8/158 |

FOREIGN PATENT DOCUMENTS

| | | |
|---|---|---|
| DE | 32 36 486 | 5/1983 |
| EP | 611 159 | 8/1994 |
| EP | 403 296 | 3/1995 |
| EP | 0 933 464 | 8/1999 |
| EP | 1 318 225 | 6/2003 |
| GB | 2 134 078 | 8/1984 |

OTHER PUBLICATIONS

PCT International Search Report in a PCT application PCT/EP 2005/011015.

PCT International Search Report in a PCT application PCT/EP 2005/010573.

* cited by examiner

*Primary Examiner*—Frankie L Stinson
(74) *Attorney, Agent, or Firm*—Rimma Mitelman

(57) ABSTRACT

A non-intrusive device for automatically dosing at least one liquid laundry care composition to an automatic laundry washing machine. The device employs a Venturi tube mechanism or a pump to dose the laundry detergent care composition. The dosing is controlled by a machine-generic algorithm capable of determining the actual cycle at any duration of wash for various cycle designs from various washing machines, without the input of precise cycle design; and dose the correct products correctly and is capable of distinguishing between major water addition and a water pulse.

22 Claims, 14 Drawing Sheets

CONTROL ALGORITHM

V=0, VALVE OFF
1, VALVE ON

P=0, PRE-WASH OFF
1, PRE-WASH ON

W=0, WATER OFF
1, WATER ON

S=0, SOAK OFF
1, SOAK ON

F=NUMBER OF MAJOR WATER ADDITION t=MASTER TIME $t_i$=TIME OF EACH PROCESS

AUTOMATIC STAND-ALONE DISPENSING DEVICE FOR LAUNDRY CARE COMPOSITION

FIELD OF THE INVENTION

Automatic, electronically-controlled dispensing device for dispensing laundry care composition into an automatic laundry washing machine, and methods for use thereof.

BACKGROUND OF THE INVENTION

Detergent compositions are provided in many forms, of which granular and liquid compositions are the most prevalent. More recently, unit dose forms of detergent have been proposed in the form of compressed tablets of detergent powder or water-soluble packages, which are consumed during a single cleaning application. The unit dose forms are preferred by some consumers, in that the dose is pre-measured and, consequently, the unit dose form is faster, easier and less messy to use. The unit dose forms, however, involve complexities in manufacture. Furthermore, unit dose detergents do not allow for variations in dosing, depending on water fill level in the machine.

Various devices for delivering ingredients in a controllable way to washing machines have been described. See, for instance U.S. Pat. Nos. 4,981,024, 3,982,666, 3,881,328, 4,103,520, 4,932,227, EP 0611,159, U.S. Pat. No. 5,207,080, US 2003/0116177, U.S. Pat. No. 4,103,520, EP 1088927, WO 03/033804, US 2004/088796, WO 03/069043, US 2003/0182732, and GB 2 134 078. The need continues to exist, however, for an improved automatic laundry care dosing device.

SUMMARY OF THE INVENTION

The present invention includes, in its first embodiment, a non-intrusive device for automatically dosing at least one liquid laundry care composition to an automatic laundry washing machine, the device located along water supply feed to the washing machine with an incoming water supply feed to the device and outgoing water supply feed out of the device, the device comprising:

- a Venturi tube, the both ends of the tube protruding externally to the device for connections to the incoming and the outgoing water supply feed,
- a dip tube for placing into laundry care composition container, the throat of the Venturi tube connected by a conduit to the dip tube;
- a sensor for determining water flow through the incoming water supply feed, the sensor located at the incoming water supply feed and connected to
- an electronic circuit containing a clock and a processing unit programmed with a machine-generic algorithm to control
- a solenoid valve, coupled to the same circuit and located within the conduit connecting the Venturi tube and the dip tube, the valve opening or closing the flow of the laundry care composition through the dip tube from the laundry care composition container.

In its second embodiment, the invention includes the variation wherein the mechanical self-priming pump is employed to dose the detergent, in place of a Venturi tube mechanism.

The inventive device is suitable for residential washing machines, as well as industrial, or commercial washing machines. The inventive device is suitable for use with front-loading or top-loading washing machines.

The following detailed description and the drawings illustrate some of the effects of the inventive compositions. The invention and the claims, however, are not limited to the following description and drawings.

Figure 1:
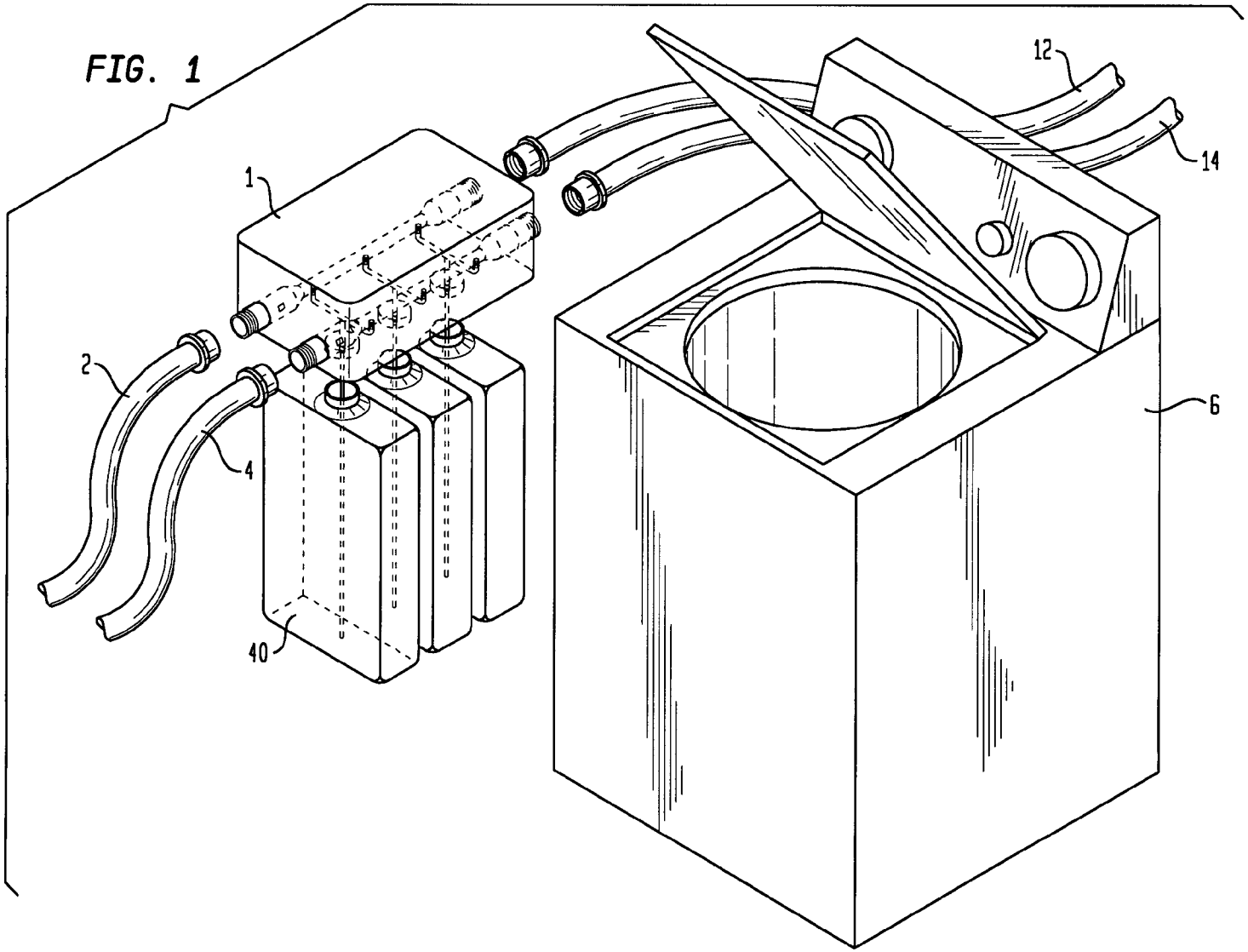
FIG. 1 is a perspective view of an inventive device according to one of the embodiments of the invention, prior to installation on a conventional laundry washing machine.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the Figures to indicate corresponding elements.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about."

It should be noted that in specifying any range of time or physical conditions, any particular upper limit can be associated with any particular lower limit.

For the avoidance of doubt the word "comprising" is intended to mean "including" but not necessarily "consisting of" or "composed of." In other words, the listed steps or options or components need not be exhaustive.

"Liquid" as used herein means that a continuous phase or predominant part of the composition is liquid and that a composition is flowable at 20° C. Solids (e.g., suspended or other) may be included. Gels and pastes are included within the liquids as used herein.

"Venturi tube" as used herein means a pipe with a constricted inner surface (throat); fluid passing through the tube speeds up as it enters the tube's throat, and generating a vacuum, which causes the dosing of a laundry care composition from a laundry care container to the washing machine.

"Non-intrusive" as used herein means external to the washing machine; can be fitted to the washing machine machine by the user of the machine, without having to invade the machine housing in any way.

"Laundry care" as used herein means any and all compositions that may be used for the cleaning and care of laundry, including but not limited to detergents, bleach, softening, anti-wrinkling, etc. and any mixtures thereof.

"Along water supply feed" means that the device is connected to the washing machine via incoming and outgoing water supply hoses, into and out of the device, the outgoing water supply hoses then leading to the washing machine.

"Machine-generic algorithm" as used herein means an algorithm that is capable of determining the actual cycle at any duration of wash for various cycle designs from various washing machines, without the input of precise cycle design; and dose the correct products correctly.

"Major water addition" is the water fill with the amount that is sufficient to pre-wash, wash or rinse the articles that to be clean in one time.

"Incoming" and "outgoing" is used herein with reference to the inventive device, to indicate flow to and out of the device.

In the following detailed description of exemplary embodiments of the invention, reference is made to the accompanying drawings, which illustrate specific exemplary embodiments in which the invention may be practiced. These embodiments are described in sufficient detail to enable those skilled in the art to practice the invention, but other embodiments may be utilized and logical, mechanical, electrical, electronic and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-know circuits, structures and techniques have not been shown in detail in order not to obscure the invention.

Figure 6:
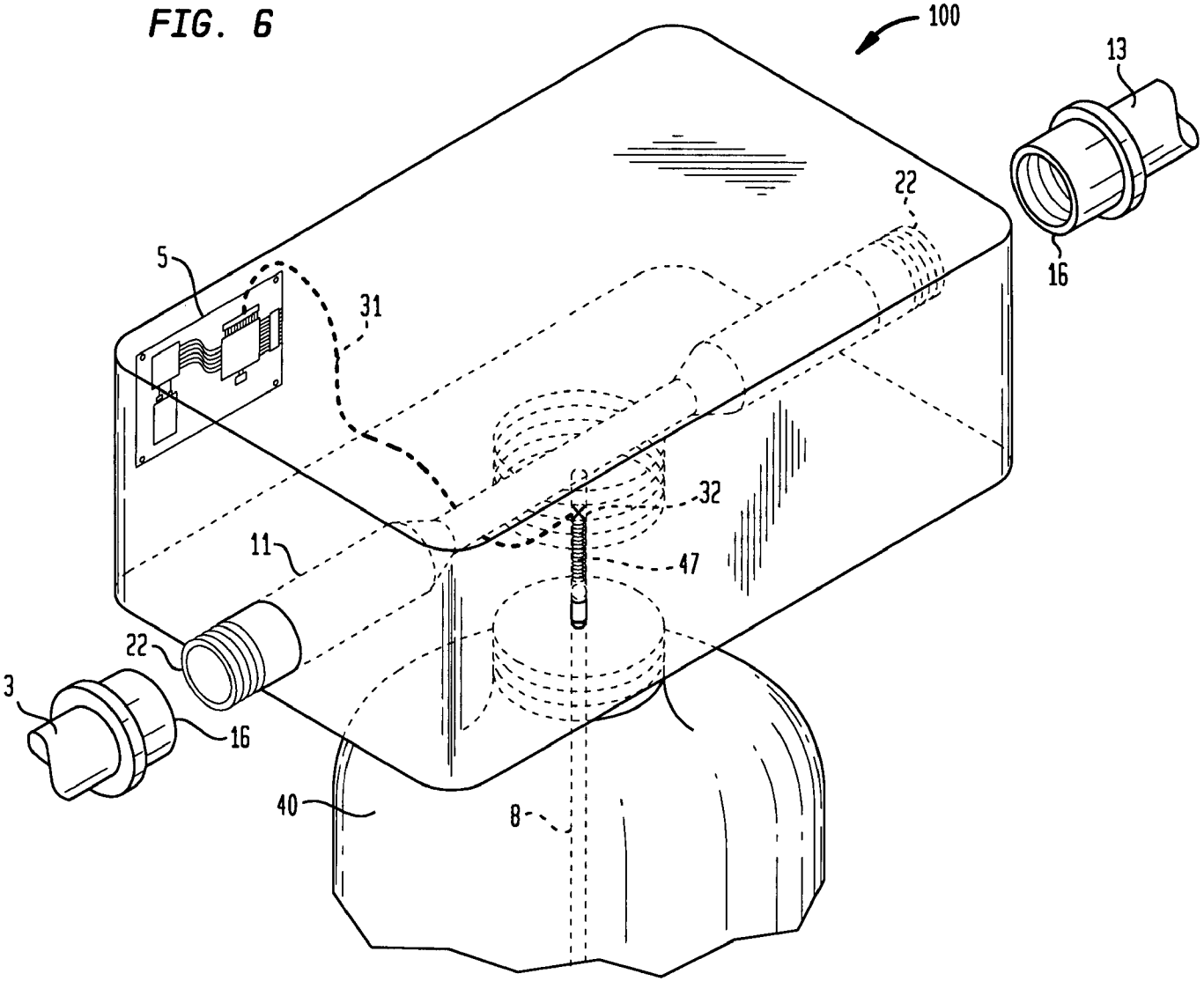
FIGS. 6 and 7 are enlarged fragmentary views of the inventive device according to other preferred embodiments of the invention.
Figure 7:
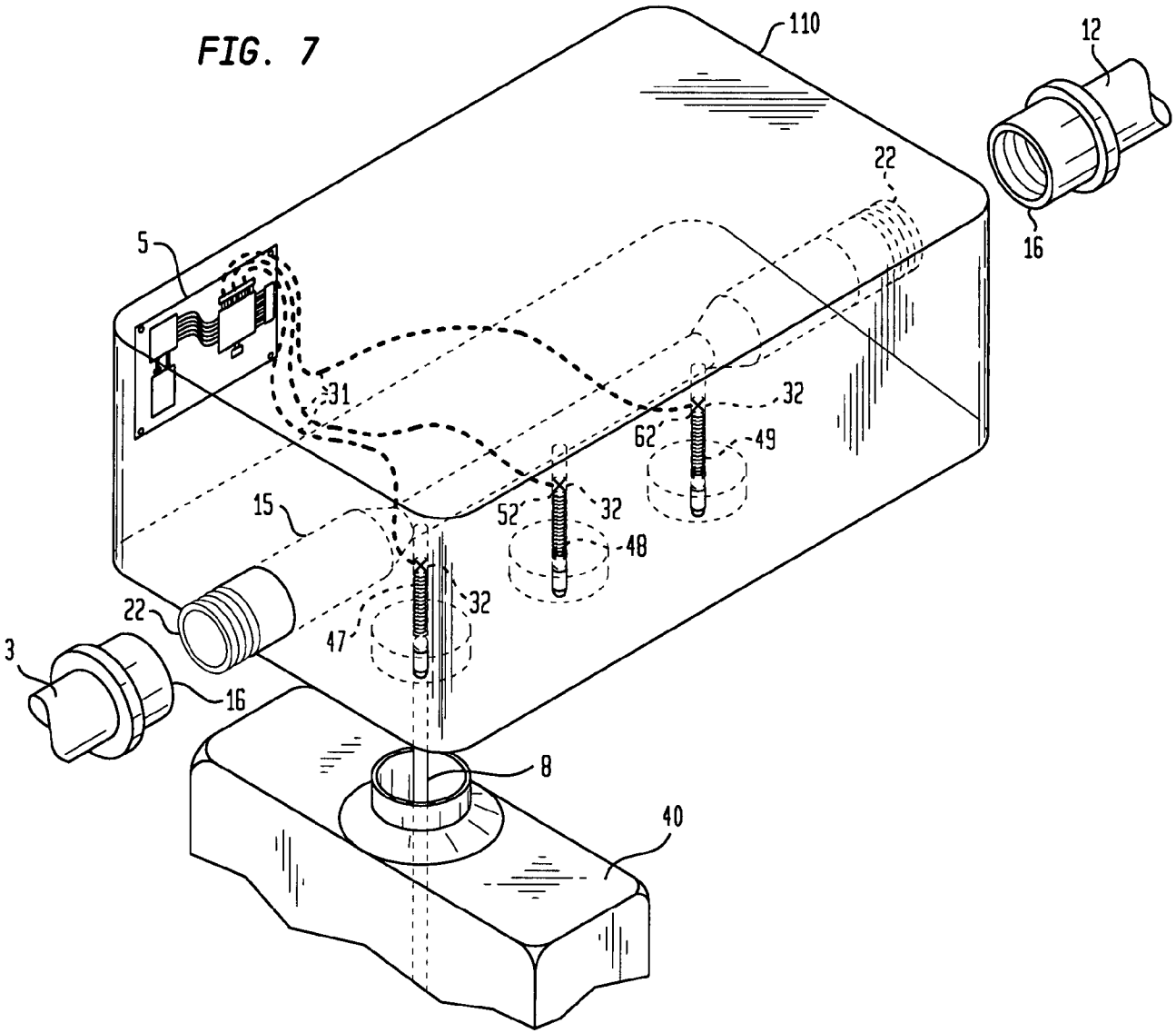
Figure 8:
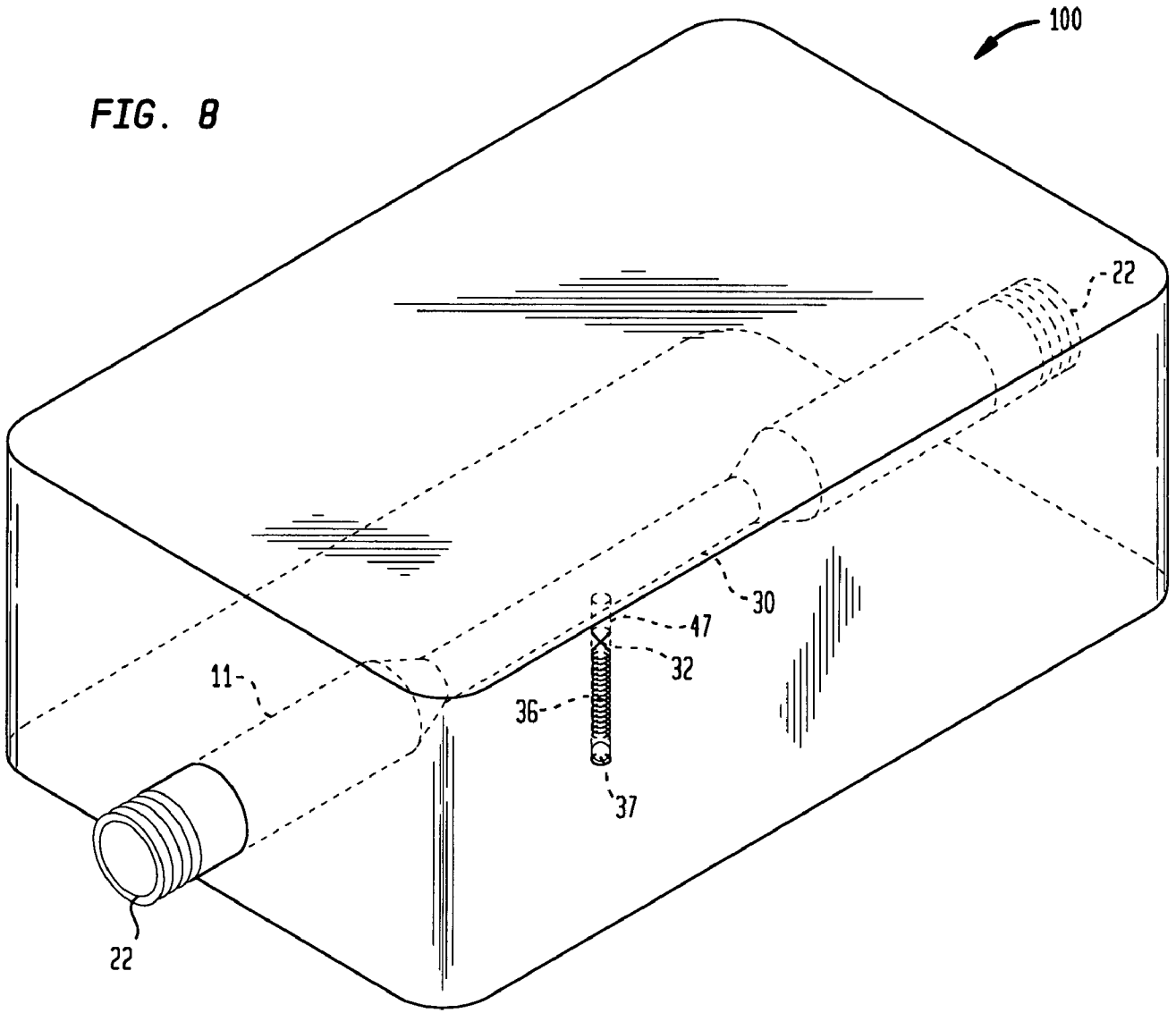
FIG. 8 is an enlarged view of the Venturi tube mechanism of the device of FIG. 6.

Turning now to the drawings, FIG. 1 is a perspective view of a preferred embodiment of the inventive device 1 prior to the installation. Device 1 connects to the incoming (2, 4) and outgoing (12, 14) water supply hoses. The outgoing hoses 12 and 14 connect the device to the washing machine 6. Typically, a pair of hoses is employed, with one connecting to hot water feed, and the other to the cold water feed. The number of the Venturi tubes within the device is generally the same as the number of water supply hoses. With a single water supply hose, the inventive device with a single Venturi tube is employed, as shown in FIGS. 6-8. Typically, the device can be located any place the only limitation being the location of the detergent container and the length of the dip tube. The device may rest on top of the control panel of the washing machine with a bracket, or, to allow easy access to the display panel of the device, and for replacing/refilling the laundry care containers.

Figure 2:
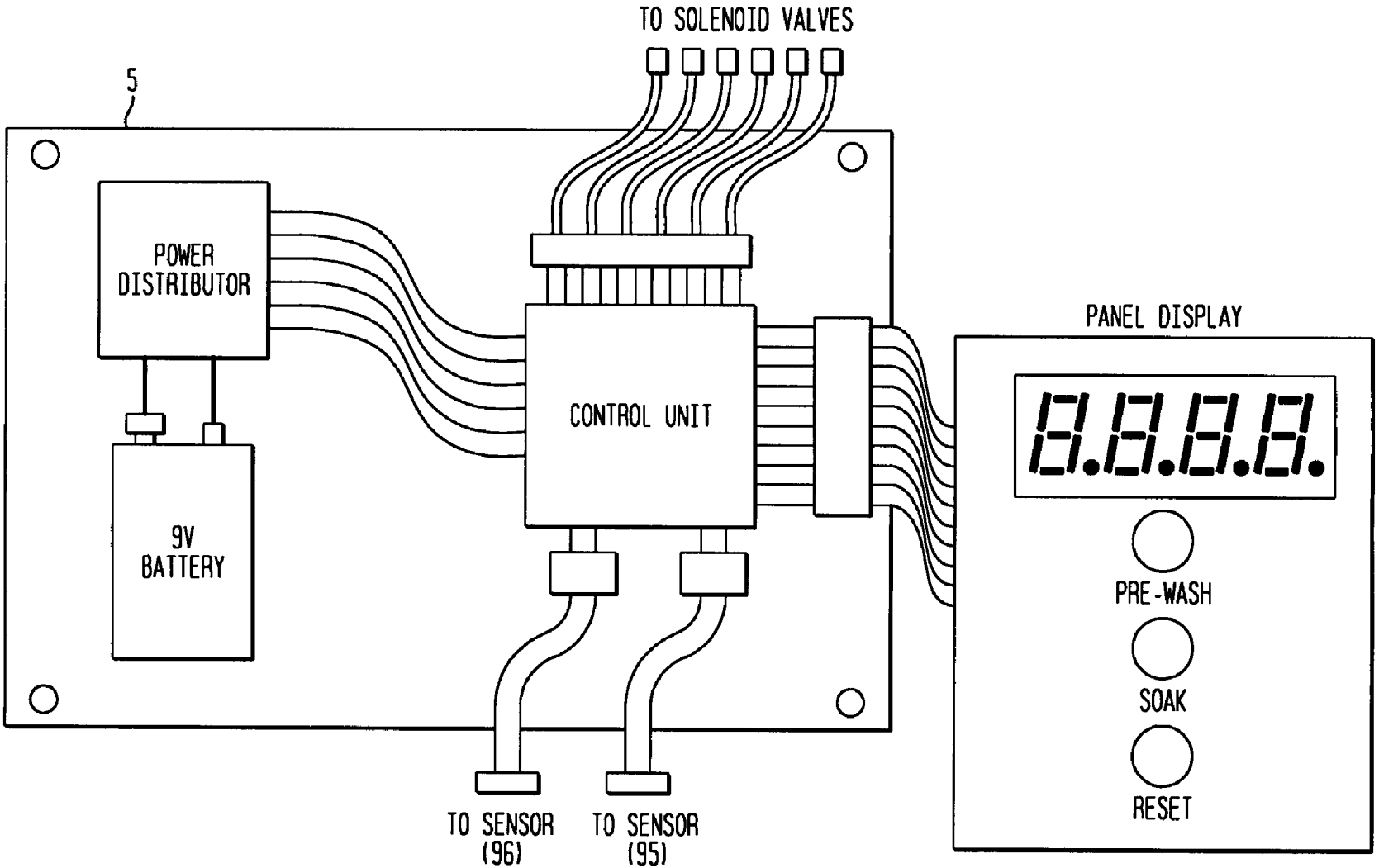
FIG. 2 is a typical block diagrammatic view of the electronic circuit board design of the inventive device according to a preferred embodiment of the invention.

FIG. 2 illustrates the typical design of the electronic circuit board 5 contained within the housing of the inventive device. The circuit board has a connector to one or more sensors (95 or 96); the sensor sends a signal to a control unit which indicates the flow of the water (on or off). The control unit contains a processing unit and a clock. In the illustrated embodiment, the clock is contained within the control unit. The control unit is further connected to the panel display and to one or more solenoid valves or within the conduits connecting Venturi tubes with laundry care containers. The processing unit is programmed with a machine-generic algorithm which processes the signal from the sensor, to control the opening or closing of the solenoid valves, at appropriate time points during the operation of the washing machine. The algorithm may be coded into a single electronic chip or a print circuit board, which is the major part of the processing unit.

The machine-generic algorithm is programmed to differentiate between a major water addition and a water pulse and to differentiate among various wash cycles. In the case of a major water addition, the algorithm determines the state of the wash process and passes the signal to open one or more of the solenoid valves corresponding to the correct products. When the solenoid valves are open, the vacuum provided by the flow of water through Venturi tubes allows the flow of one or more of the laundry care compositions to the water stream that is filling the wash machine. The algorithm can also be programmed to open only the solenoid valve which is connected to the Venturi tube with the water flowing through it at that moment in order to prevent the cross-contamination between hot and cold water lines (which happens when both solenoid valves connected to both water lines are open). In other words, only one water supply (hot or cold) might be on, and that is the one that will prompt the appropriate solenoid valve to open.

Figure 3:
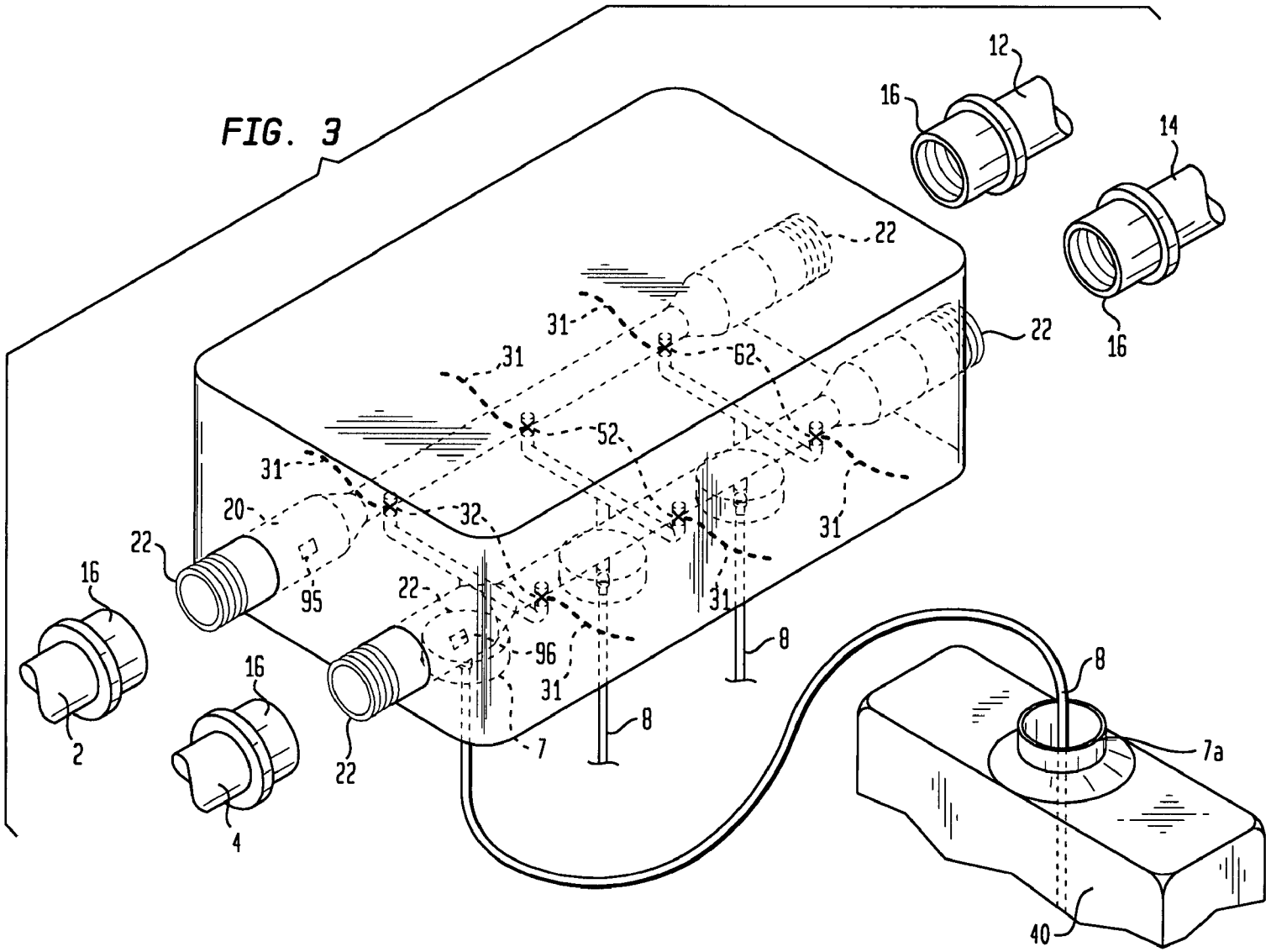
FIG. 3 is an enlarged fragmentary view of the inventive device in FIG. 1.
Figure 4:
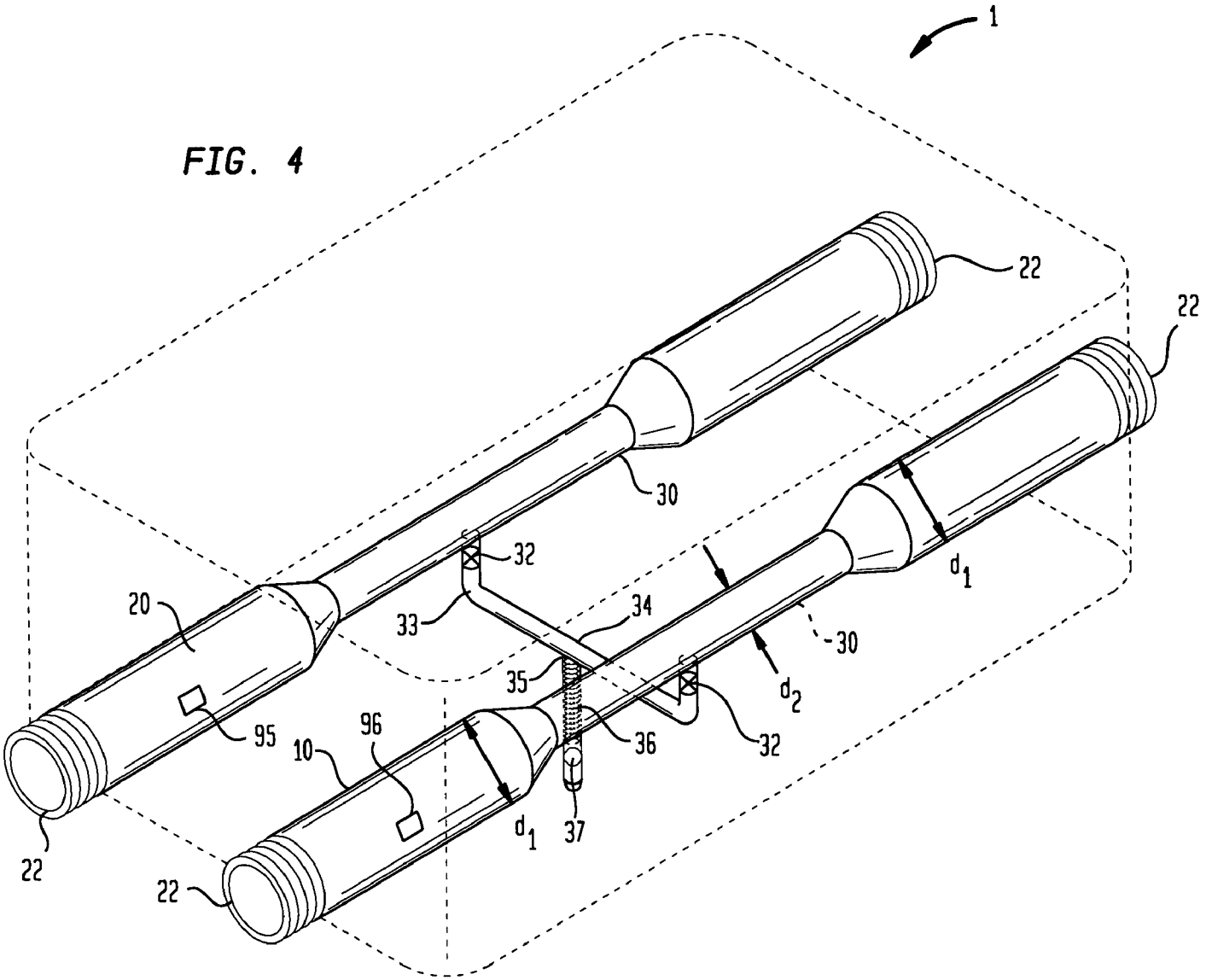
FIG. 4 is an enlarged view of the Venturi tube mechanism of the device of FIG. 1.
Figure 5:
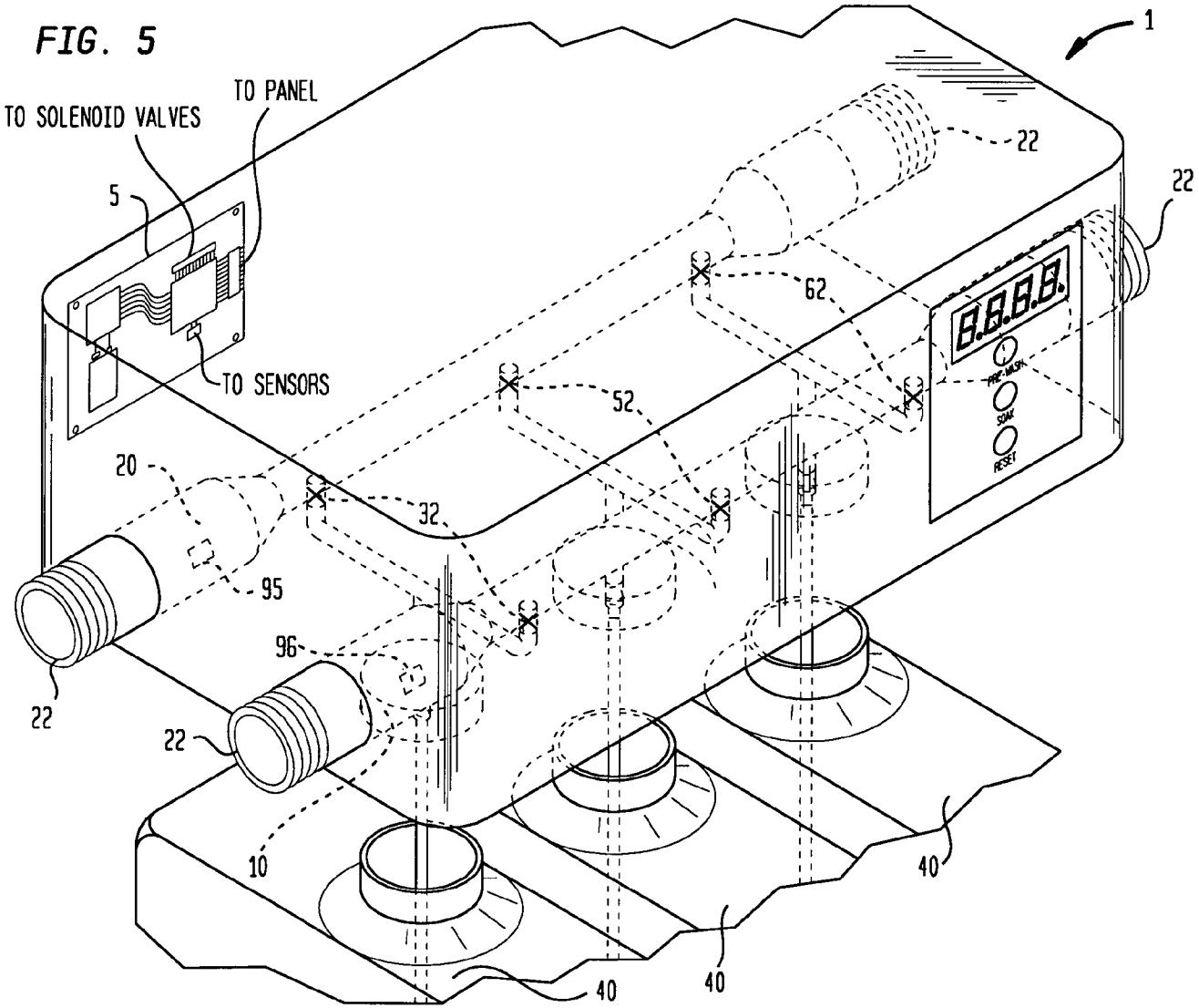
FIG. 5 is a perspective view of the device in FIG. 1.

FIGS. 3, 4 and 5 illustrate the mechanism of the dosing of a laundry care composition via a preferred embodiment of the inventive device 1. If the algorithm processes the instruction to mean that a major water addition is occurring via incoming hoses 2 and/or 4, the signal is sent from the control unit to the solenoid valves 32, and/or 52 and/or 62 to open (the solenoid valves being connected by wires 31 to the electronic circuit 5), which then results, due to the vacuum in the throats 30 of the Venturi tubes 10 and 20, in the flow of a laundry care composition out of the laundry care container 40. The container 40, in use, snaps via connections 7 and 7*a*, so that the dip tube 8 connects to a conduit 35, sealed. The laundry care composition flows up the dip tube 8, 35, 34, 33 and 32 (FIG. 4), mixing with the incoming water flow in the Venturi tubes, and exiting the dosing device via the outgoing water hoses 12 and 14. The resulting water/laundry care mix is carried into the washing machine via hoses 12 and/or 14. The device in FIG. 3 contains connections to three laundry care containers 40, according to the most preferred embodiment of the invention. Depending on the instructions received from the algorithm (differentiating between the wash cycles), different sets of solenoid valves—32, 52, or 62—are open to allow various laundry care compositions to flow. Preferably, the inventive device connects to a laundry detergent container, a fabric softener/fabric care container, and/or a bleach or a laundry booster container.

The dip tube is preferably made of flexible material, especially preferably made of polyethylene and/or polypropylene The length of the throat portion of the Venturi tube is preferably from 1 to 20 cm, more preferably less than 10 cm, most preferably less than 5 cm. The multiple connections from the throat to the containers of laundry products may be distributed along the axial direction or/and the perimeter of the throat.

The preferred inventive devices contain a safety check assembly within the conduit 35. The safety assembly may be assembled in a variety of ways. One of the embodiments is shown in detail in FIG. 4. The safety assembly prevents the flow of the laundry care composition down the conduit 35, if the solenoid valve is open (e.g. malfunctioning, stuck), but there is no water flow through the Venturi tubes. The safety assembly contains, optionally, spring 36, upon which rests a ball 37. If there is no water flow through throats 30 of the Venturi tubes, there is no vacuum to force the flow of the laundry care composition down the spout 38, the spring 36 remains at rest, with the ball 37 blocking the flow of the composition.

Figure 4A:
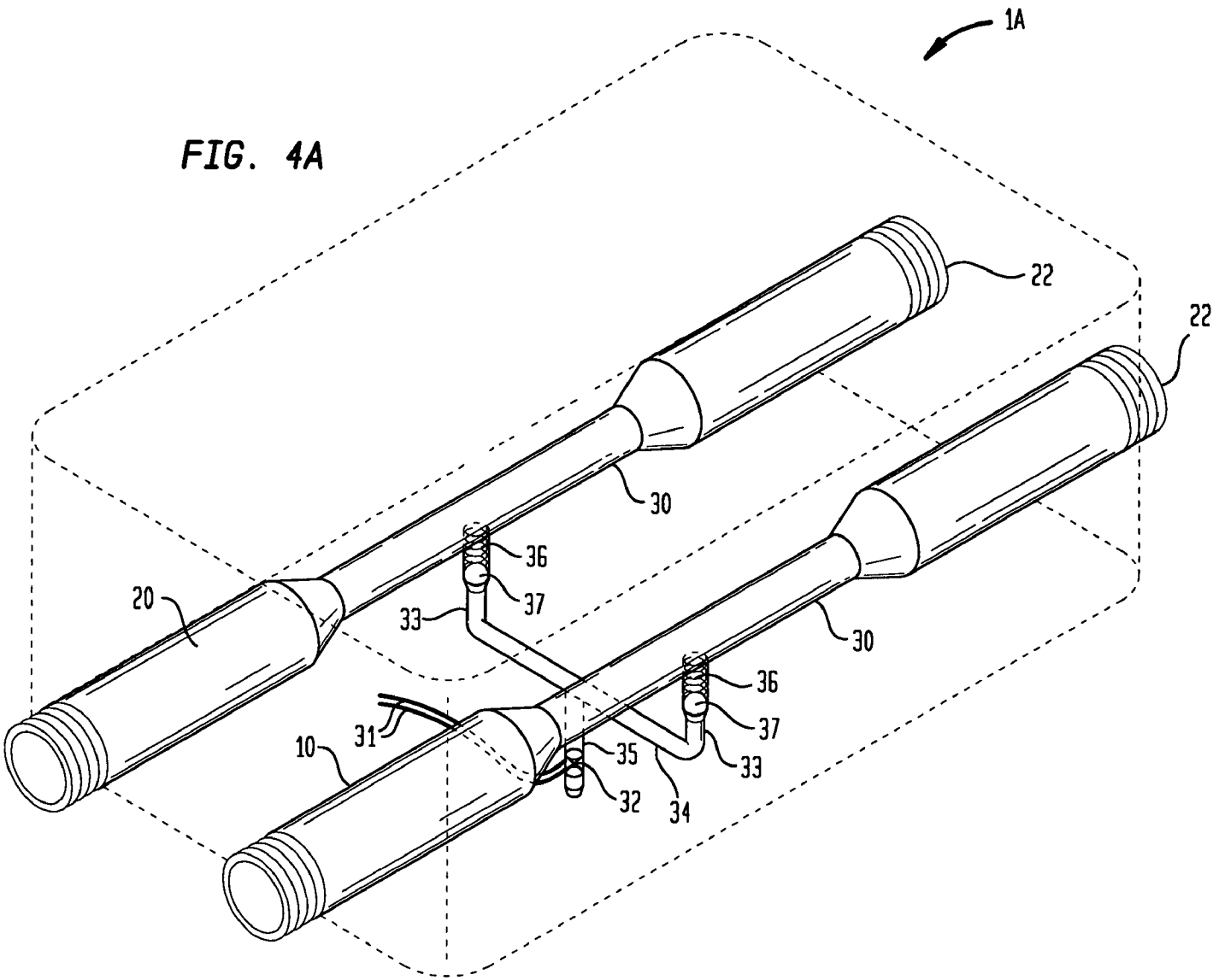
FIG. 4A is an en enlarged view of the an alternative dosing mechanism of the device of FIG. 1 (a pump in place of the Venturi tube mechanism)

FIG. 4A illustrates another preferred embodiment (device 1A). It is preferred because only one solenoid valve or pump is employed. The other reason is that the safety valve is not open for the line which is without water flow. If the algorithm processes the instruction to mean that a major water addition is occurring via incoming hoses 2 and/or 4, the signal is sent from the control unit to the solenoid valve 32, which is located in the conduit 35, to open (the solenoid valve being connected by wires 31 to the electronic circuit 5), which then results in the flow of a laundry care composition out of the laundry care container 40, up the dip tube 8, then up the conduits 35, 34, and 33. The check valve assemblies (optionally spring 36 and ball 35) are located at the conduits 33, which are directly connected to each of hot and cold water lines. The safety valves are open due to the vacuum in the throat 30 generated by the water flow in the Venturi tubes 10 and/or 20, correspondingly. The flow of product then is mixing with the incoming water flow in the Venturi tubes, and exiting the dosing device via the outgoing water hoses 12 and 14. The resulting water/laundry care mix is carried into the washing machine via hoses 12 and/or 14.

According to the preferred embodiment of the invention, the ratio of the diameter of the end of the Venturi tube ($d_1$) to the diameter of the throat of the Venturi tube ($d_2$) is greater than 1.65, most preferably greater than 2.5, in order to attain the required vacuum for dosing the products. If the internal diameter of water hoses is less than the diameter of the end of the Venturi tube ($d_1$), then the preferred ratio should be based on the ratio of the internal diameter of water hose to the diameter of the throat of the Venturi tube ($d_2$).

FIGS. 6, 7, and 8 illustrate yet other embodiments of the inventive devices 100 and 110 wherein a single water supply and a single Venturi tube are employed. The Venturi tube 11 in FIG. 6 or 15 in FIG. 7 is connected to the incoming water supply hose 3 and the outgoing water supply hose 13 via couplings 16 and 22. The mechanism of dosing action is the same as described above for FIGS. 3, 4, and 5, except that when a single Venturi tube 11 or 15 is employed, it connects directly through the conduit 47 to the laundry care container 40 (contrasted to a series of conduits 33, 34, and 35 in FIG. 4 for a double Venturi tube device).

FIG. 6 illustrates a single Venturi tube/single laundry care container embodiment of the inventive device 100, while FIG. 7 illustrates a single Venturi tube/three laundry care containers embodiment of the device 110. The Venturi tube 11 in FIG. 6 connects to a single laundry care container via a single conduit 47. The Venturi tube 15 in FIG. 7 connects to three laundry containers directly via conduits 47, 48, and 49.

FIG. 8 illustrates the example of the safety assembly for the single Venturi tube embodiment of the device, operating as described above with reference to FIG. 4.

Figure 9:
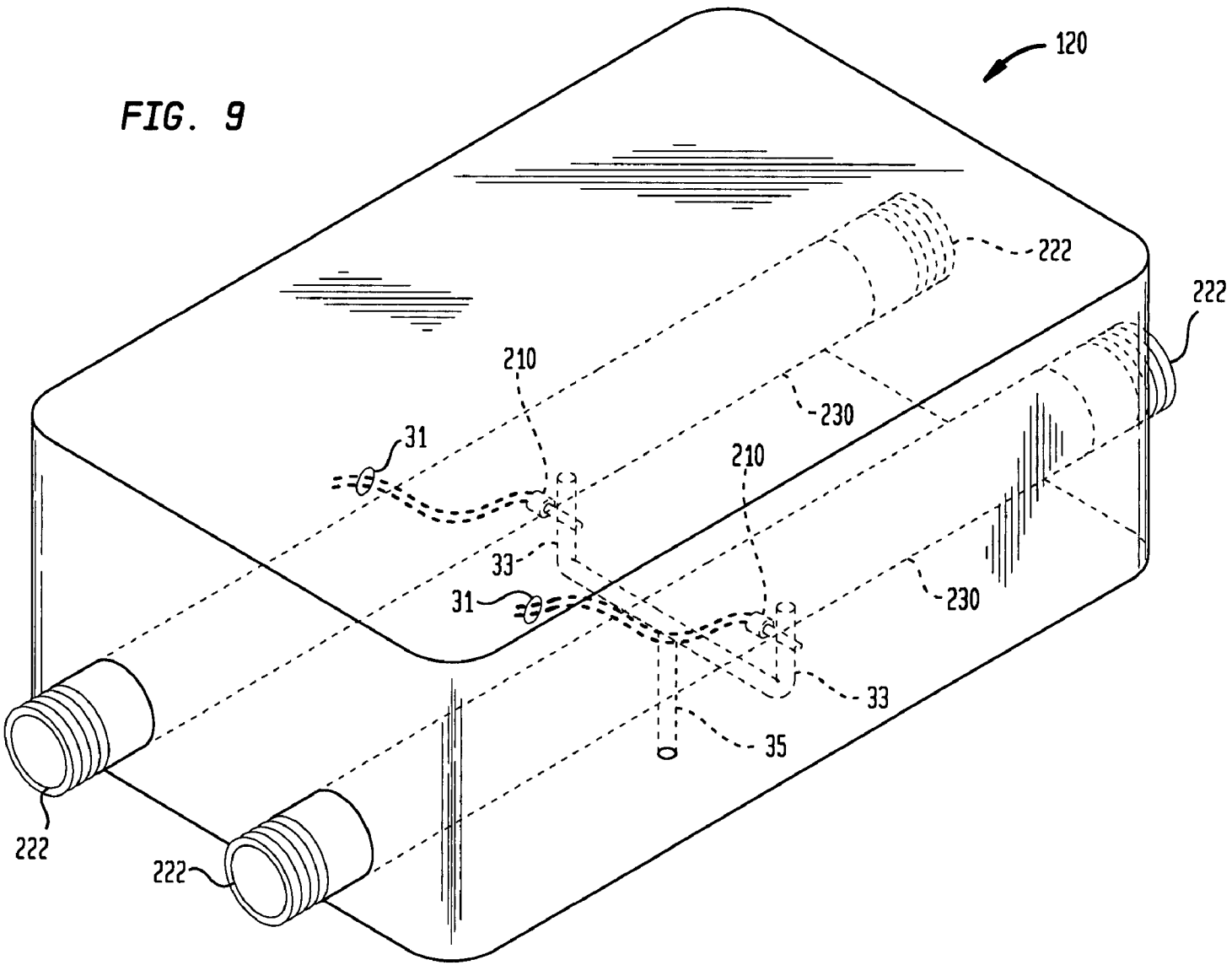
FIG. 9 is an enlarged fragmentary view of the inventive device according to another preferred embodiment of the invention, employing a pump mechanism, in place of the Venturi tube mechanism.
Figure 10A:
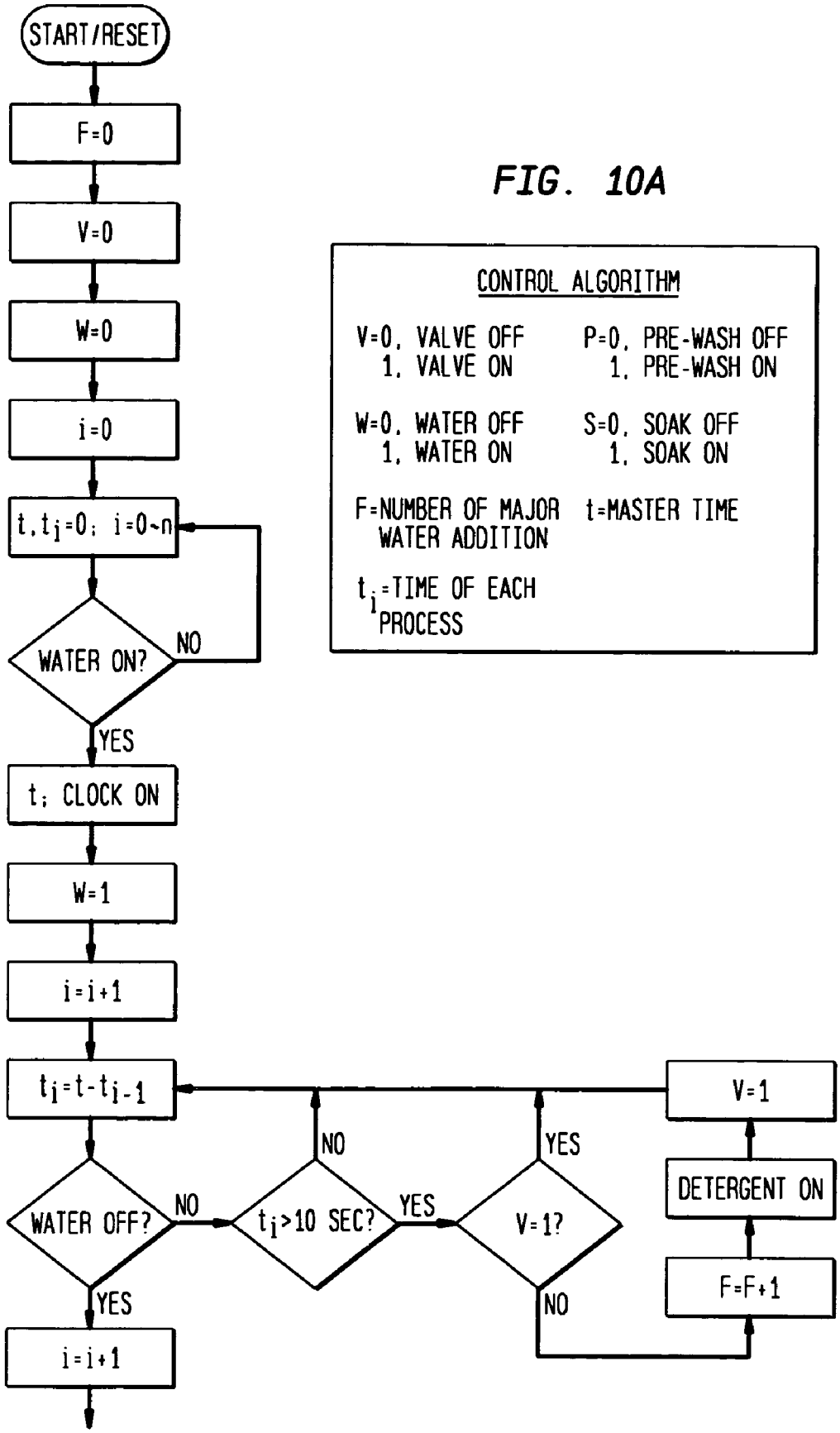
FIGS. 10A, 10B, 11A and 11B are logic flow diagrams for algorithms according to the preferred embodiments of the invention.
Figure 10B:
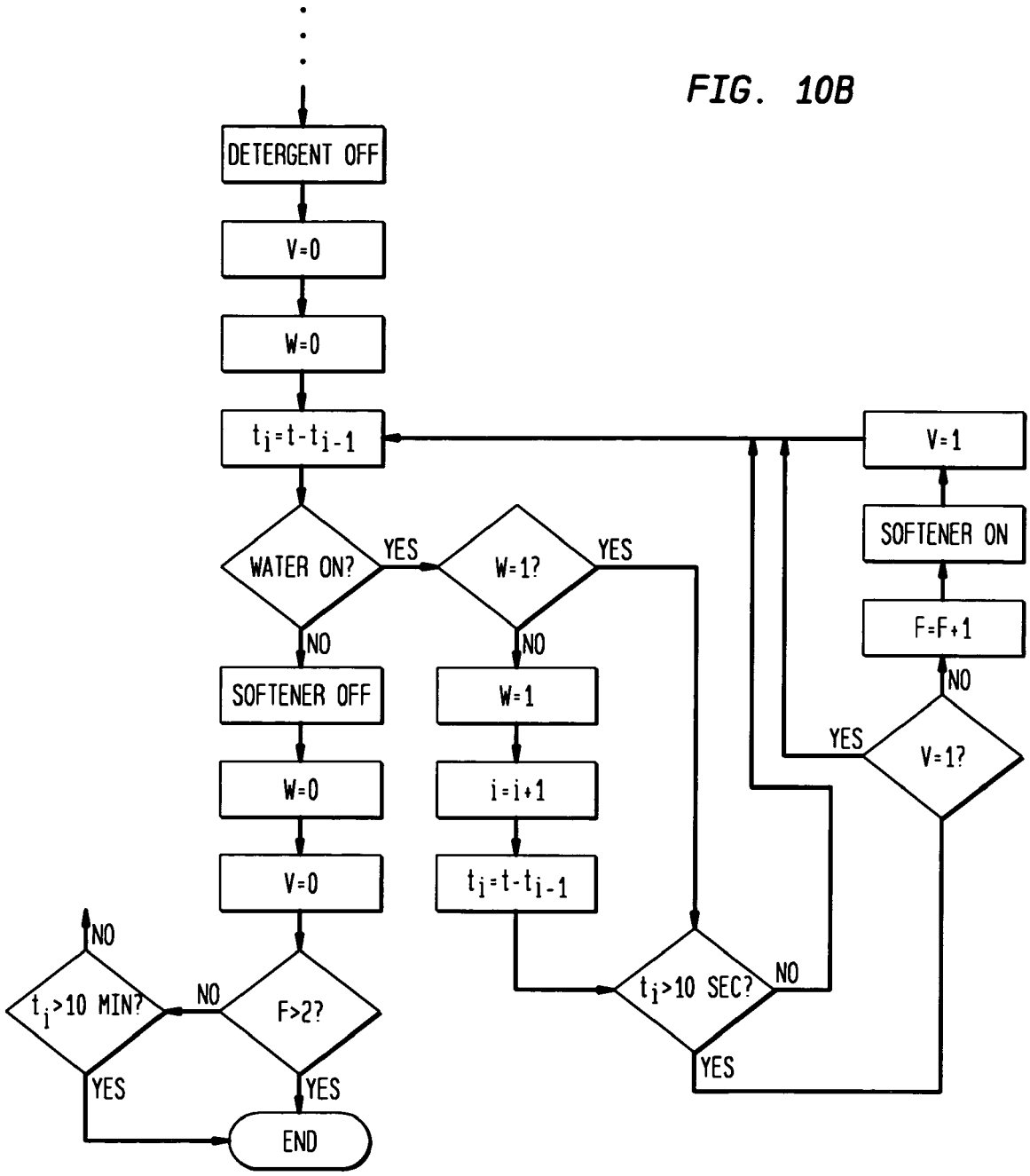

FIG. 9 illustrates an alternative embodiment of the invention. The inventive device 120 operates substantially the same as described above in connection with FIGS. 3-5, except that a pump 210 is employed in place of a Venturi mechanism. The device with pump is highly preferred for washing machines which are placed at a low water pressure locations. Otherwise, according to the present invention, the Venturi mechanism is preferred, since it has no moving parts, as in the pump. In addition, the Venturi-based device does not require an external power supply, only a battery to run the electronic circuit to control the solenoid valves. The pump-based device in FIG. 9 employs simple tubes 230 in place of the Venturi tubes. Similarly to the Venturi-based inventive devices, it may include single or dual water supply, either one in combination with a variety of dosing containers.

Figure 11A:
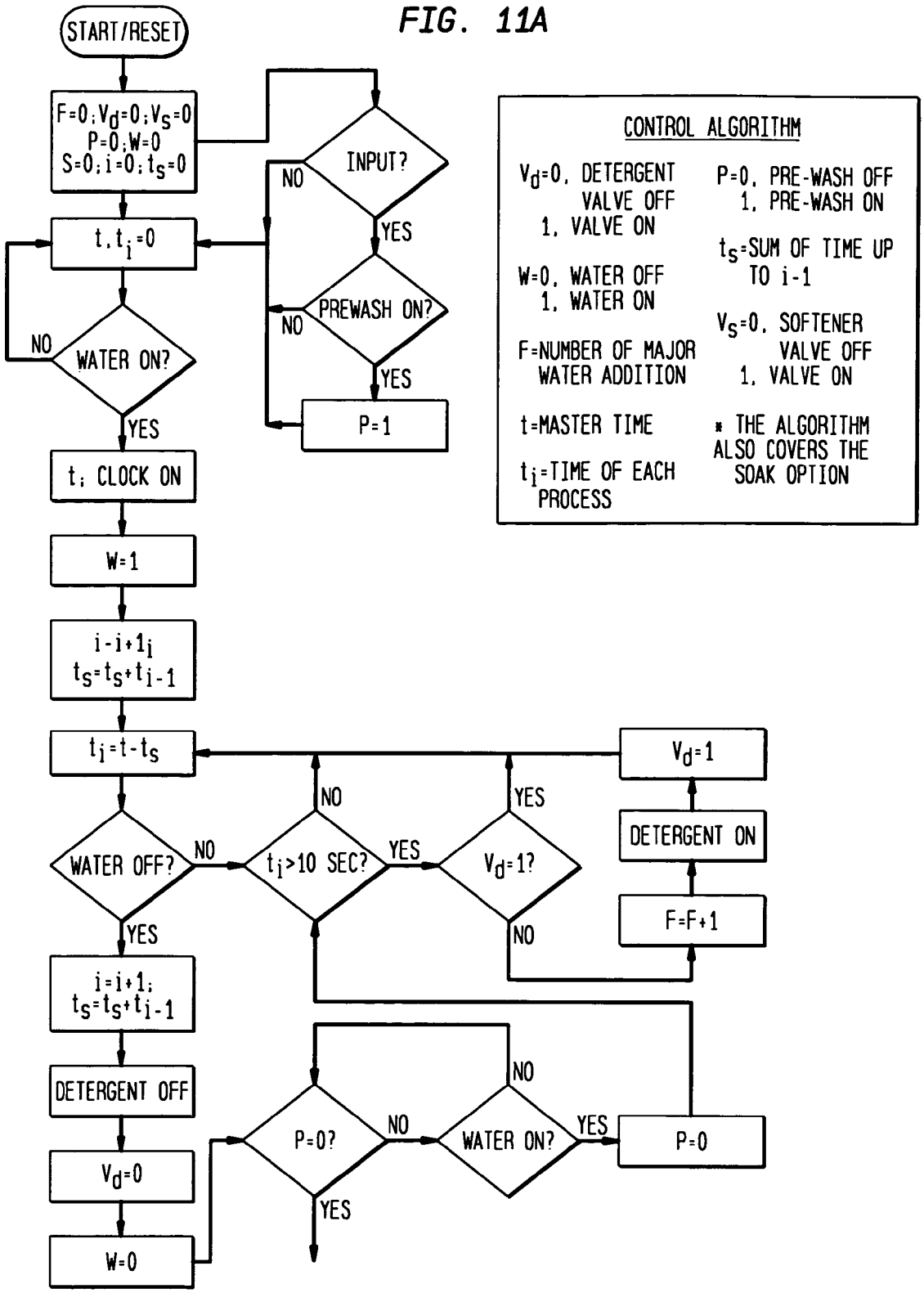
Figure 11B:
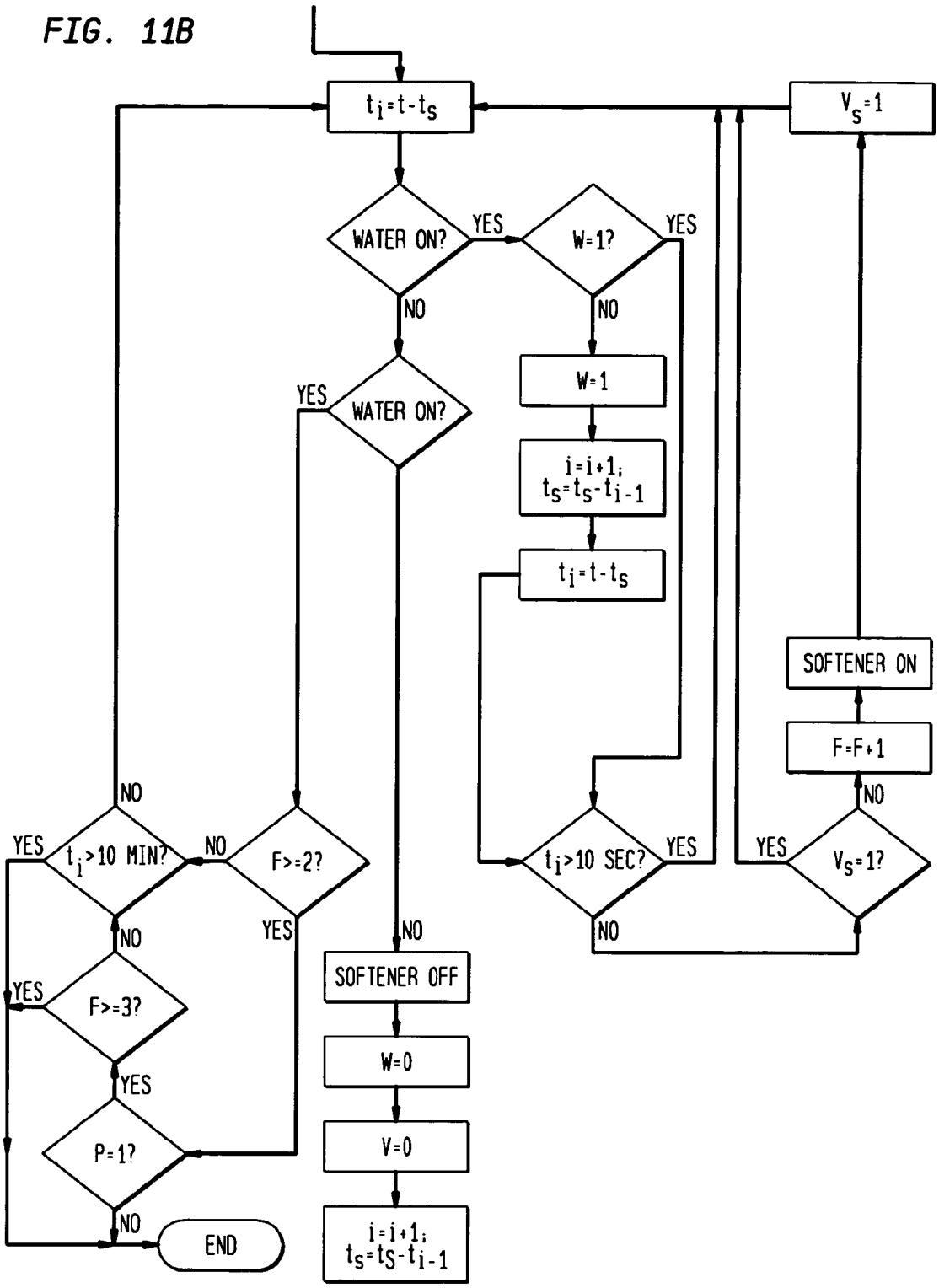

FIGS. 10A, 10B, 11A and 11B are examples of the logic flow diagrams for the machine-generic algorithm for programming the processing unit. It can be seen that the algorithm for the operation of the inventive device distinguishes between the major water addition and the water pulse, depending on the duration of the water flow. Thus, if the water flow is on for longer than about 5 to 30 seconds, preferably longer than 15, more preferably longer than 10 seconds, then the algorithm processes this information as a major water addition and sends the signal to open the corresponding solenoid valves or pumps to cause the dosing of the correct laundry care composition. The machine-generic algorithm also contains instructions for resetting itself and for distinguishing whether the water addition is the initial water addition in the laundry cycle or the successive water addition, resulting in the instructions sent for solenoid valve or pump leading to the second laundry care composition to open if chosen so by the user. The machine-generic algorithm may contain various options which would be selected by the user on the display panel of the device, which selections would send instructions to the algorithm within the processing unit of the device. Thus, FIGS. 11A and 11B illustrate a more complicated algorithm for the laundry cycle with the pre-wash option. The display panel may contain various buttons to allow the user to manipulate the algorithm: e.g., pre-wash, bleach, booster, fabric softener, reset buttons, type of wash, wash load, etc. The algorithm and the processing unit may also include the detection and the display of the low power of battery or malfunction. The processing unit may contain a ROM chip. The algorithm in the electronic circuit is then upgradable via switching to a new ROM chip containing a new algorithm or via flashing the ROM with a new algorithm.

Sensor

The sensor senses the flow of water converting a flow signal therefrom into an electronic impulse, and sending the signal that the water flow is on to the processing unit inside the control unit. The preferred sensor is selected from a pressure transducer or a flow or motion sensing devices, or combinations thereof.

The sensor can be placed at a water supply feed, whether the incoming or outgoing feed from the device. The sensor combined with the algorithm may additionally detect other parameters, e.g. water inflow pattern, total water consumed for each cycle. By the use of the sensors, signals can be obtained (and combined with one another) which monitor the wash cycle and the cycle time and provide a trigger for the inventive dispensing device. Other suitable sensors include but are not limited to devices sensing electrical current, sound, temperature, vibration, etc.

Laundry Care Containers

Generally, any laundry care container may be used as long as its spout fits snugly into the conduit leading to the Venturi tube. In the preferred embodiment of the invention, however, special cartridges, most preferably removable and replaceable, are employed.

In a preferred embodiment of the invention, to prevent user mistakes in inserting wrong containers into the slot, the slots and/or containers are clearly labeled and may have an encoded set of information about the container's contents and its use instructions affixed to it, the device further comprising means for retrieving and, optionally, storing said information, and means for executing instructions either received directly from the retrieved information or from the stored information. The instructions may be in the form of a bar code, a magnetic strip, a microchip or any other suitable machine-readable attachment. In another embodiment of the invention, the shape of the containers and the corresponding interlocking slots are shaped differently to prevent misplaced installation of products. Another way of preventing misplaced installation is via color or shape or size differention with common interlocks.

Laundry Care Compositions

Any laundry care compositions are suitable for use with the inventive device. The particular advantage of the inventive device is that it pre-mixes the laundry care composition with water, thus diluting the laundry care composition prior to its introduction into the washing machine. Thus, in a particularly preferred embodiment of the invention the laundry care composition is a concentrate. For a laundry detergent composition, it generally means that the composition comprises at least 20%, by weight of the composition, preferably from 40 to 100%, most preferably from 60 to 100% of a surfactant. Generally, concentrate compositions contain little if any water, generally from 0 to 50%, preferably less than 20%, most preferably less than 10%.

Another particularly preferred composition for use with the inventive device is a bleach composition; by virtue of pre-dilution associated with the use of the inventive device such composition may be introduced into the washing machine, without causing the pinpoint damage to the fabrics. The most preferred bleach is a peracid, such as imidoperacid, diperoxydodecanoic acid (DPDA), perlauric acid, perbenzoic and alkylperbenzoic acids. Especially preferred peracid is phthalimido-percaproic acid (PAP). In another embodiment, the inventive device may dose sodium hypochlorite solution, which is generally referred to as chlorine beach. The concentration of hypochlorite solution is in the range between 1.5% to 10%, preferably between 3 to 7%.

In another embodiment, the inventive device may sequentially dose bleach precursors and peroxygen bleach sources. The nonanoyloxybenzene sulfonate (NOBS) and tetraacetyl ethylene diamine (TAED) are typical bleach precursors. Other classes of bleach precursors comprise acylated citrate ester, benzoxazin-type and amido derived precusors. Suitable peroxygen bleach bleach sources to be used herein are hydrogen peroxide, percarbonates, persilicates, perborates, peroxyacids, hydroperoxides, and diacyl peroxide. As used herein a peroxygen bleach source refers to any compound, which produces perhydroxyl ions when said compound is in contact with water.

What is claimed is:

1. A non-intrusive device for automatically dosing at least one liquid laundry care composition to an automatic laundry washing machine, from a laundry care composition container the device located along water supply feed to the washing machine with an incoming water supply feed to the device and outgoing water supply feed out of the device, the device comprising:

a Venturi tube, the both ends of the tube protruding externally to the device for connections to the incoming and the outgoing water supply feed, a dip tube for placing into laundry care composition container, the throat of the Venturi tube connected by a conduit to the dip tube;

a sensor for determining water flow through the incoming water supply feed, the sensor located at the incoming water supply feed and connected to an electronic circuit containing a clock and a processing unit programmed with a machine-generic algorithm to control a solenoid valve, coupled to the same circuit and located within the conduit connecting the Venturi tube and the dip tube, the valve opening or closing the flow of the laundry care composition through the dip tube from the laundry care composition container.

2. The device of claim 1 comprising at least two dip tubes, one for dosing a laundry detergent and the other for dosing a fabric softener.

3. The device of claim 1 connected to two water supply feeds: hot water and cold water.

4. The device of claim 3 comprising two Venturi tubes, one connected to the hot water supply feed; the other connected to the cold water supply feed.

5. The device of claim 4, wherein the throats of the two Venturi tubes are connected to each other by a connecting conduit, the connecting conduit being in turn connected to the conduit to the dip tube.

6. The device of claim 1, wherein the sensor is selected from a pressure transducer and a flow sensor.

7. The device of claim 1 wherein the processing unit comprises a clock.

8. The device of claim 1 wherein the algorithm resets the clock at the end of the total laundry cycle.

9. The device of claim 1 wherein the algorithm differentiates between various wash cycles based on the number of major water additions.

10. The device of claim 1 wherein the algorithm differentiates between a water pulse and a major water addition.

11. The device of claim 1 wherein the algorithm comprises the instructions to open the solenoid valve which is connected to the Venturi tube which has water flow through it on for longer than about 5 to 30 seconds.

12. The device of claim 1 wherein the algorithm comprises instructions to close the solenoid valve if water flow is off.

13. The device of claim 1 wherein the device comprises two dip tubes: for dosing a laundry detergent and for dosing a laundry softener and wherein the algorithm comprises the instructions to open the solenoid valve controlling the laundry softener dip tube at the point of the second major water addition.

14. The device of claim 1 wherein the device further comprises a safety check assembly located in the conduit connecting the Venturi tube and the dip tube, to prevent water flow into a laundry care container.

15. The device of claim 1 wherein the Venturi tube is connected to two or more dip tubes, to each through a separate opening in its throat connected to a separate conduit to each dip tube.

16. The device of claim 1 further comprising a control panel comprising a selection for reset and for pre-wash.

17. The device of claim 1 wherein the ratio of the internal diameter of the end of the Venturi tube to the internal diameter of the throat of the Venturi tube is greater than 1.65.

18. The device of claim 1 wherein the ratio of the internal diameter of a water supply feed hose to the internal diameter of the throat of the Venturi tube is greater than 1.65.

19. The device of claim 1 wherein the dip tube is removable.

20. The device of claim 1 wherein the laundry care composition is a concentrated composition.

21. The device of claim 1 wherein the laundry care composition comprises a peracid or chlorine bleach.

22. The device of claim 1 wherein the algorithm in the electronic circuit is upgradable via switching a new ROM chip containing a new algorithm or via flashing the ROM with a new algorithm.

* * * * *